US006309160B1

(12) United States Patent
Greene, Jr.

(10) Patent No.: US 6,309,160 B1
(45) Date of Patent: Oct. 30, 2001

(54) OFFSHORE PERSONNEL TRANSFER SYSTEM

(76) Inventor: George J Greene, Jr., 19970 Holly Hills Dr., LaRue, TX (US) 75770-9756

( * ) Notice: Subject to any disclaimer, the term of this patent is extended or adjusted under 35 U.S.C. 154(b) by 0 days.

(21) Appl. No.: 09/621,886

(22) Filed: Jul. 22, 2000

Related U.S. Application Data

(60) Provisional application No. 60/146,271, filed on Jul. 29, 1999.

(51) Int. Cl.[7] ..... B63B 27/00

(52) U.S. Cl. ..... 414/139.5; 114/362

(58) Field of Search ..... 414/138.5, 139.4, 414/139.5, 139.6, 139.7; 114/362, 343

(56) References Cited

U.S. PATENT DOCUMENTS

| | | | |
|---|---|---|---|
| 2,641,785 | 6/1953 | Pitts et al. . | |
| 2,874,855 | 2/1959 | Rees, Jr. . | |
| 2,876,919 | 4/1959 | True et al. . | |
| 2,963,178 | 12/1960 | Walker . | |
| 2,963,179 | 12/1960 | Kanady et al. . | |
| 3,064,829 | 11/1962 | Winfrey et al. . | |
| 3,426,719 | 2/1969 | Mizell . | |
| 4,166,517 | 9/1979 | Henderson | 187/6 |
| 4,180,362 | 12/1979 | Stair | 414/139 |
| 4,369,538 | 1/1983 | Smedal | 14/69.5 |
| 4,395,178 | 7/1983 | MacDonell et al. | 414/138 |
| 4,412,598 | 11/1983 | Kimon et al. | 182/19 |
| 4,590,634 | 5/1986 | Williams | 14/71.1 |
| 4,601,253 | 7/1986 | Anders | 114/362 |
| 4,602,697 | 7/1986 | Aanensen | 182/48 |
| 4,630,542 | 12/1986 | Peyre et al. | 104/114 |
| 4,739,721 | 4/1988 | Peyre | 114/348 |
| 5,713,710 | 2/1998 | Strong et al. | 414/139.5 |

OTHER PUBLICATIONS

1995 Spider Technical Data Sheet—Powered Hoists.

*Primary Examiner*—Kenneth W. Noland
(74) *Attorney, Agent, or Firm*—C. W. Alworth

(57) ABSTRACT

An Offshore Personnel Transfer System moving men and materials between an offshore platform, or any oil and gas facility such as semi-submersibles, jack-ups, and the like, and a workboat is disclosed. The system does NOT require any special equipment on the workboat and is self powered deriving its energy from standard energy sources found on offshore facilities. Furthermore the system is comprised of standard off-the-shelf components.

22 Claims, 15 Drawing Sheets

OFFSHORE PERSONNEL TRANSFER SYSTEM

This application claims the benefit of U.S Provisional Application 60/146,271, filed on Jul. 29, 1999.

TECHNICAL FIELD OF THE INVENTION

The present invention relates generally to safety devices and in particular to an apparatus and method for safely transferring personnel between offshore platforms and surface ships.

BACKGROUND OF THE INVENTION AND PRIOR ART

The inventor has worked in the field of safety in the workplace for some twenty-five years and has performed considerable work on safety studies dealing with offshore drilling and production platforms. His studies have determined that one of the major causes of injury, particularly spinal injury, results from workmen entering or leaving stationary platforms to enter or leave a workboat. Because of the swells in the open ocean, the workboats cannot tie directly to the stationery platform structure and move up and down in the swells causing a serious problem for personnel who need to move between a platform and a workboat.

In rough seas it is not uncommon for the boat to be positioned eight or more feet from the platform. Because of the pitching of the boat (normally three to five feet of vertical movement) a workman may slip or land improperly on the boat or platform, causing disabling injuries.

The accepted (and archaic method) to transfer a workman from a workboat to a platform employs a "Swing Rope" (see FIG. 1). The swing rope is suspended from the upper deck of a platform and extends past the landing platform that is located several feet above mean sea level. The rope will often touch the sea at mean tide and be several feet above the sea at low tide. The swing ropes each have a series of knots, to stop a users hand from slipping, spaced about several feet apart. The use of the rope varies depending on the relative position of the user.

If the user is on the platform, the user judges the mean height of the work boat above or below the platform and grabs the rope at the appropriate knot. (The actual technique is difficult to describe, should be explained by a video, and must be experienced by a person to fully understand the method. After one's first experience, one will still be terrified!) The user then swings out over the water, over the boat, moves the hands over knots—if necessary, slides down the rope, lets go, and drops on the deck of the boat.

Timing of the drop is critical; the user should swing out from the platform and let go of the rope just as the boat is falling away from the platform due to wave motion. Injury will occur, if the workman mis-times and drops, as the boat is moving upward. NOTE—mis-timing can be handled by simply returning to the platform. Transfer from platform to boat is difficult, but certainly easier than transfer from boat to platform.

If the user is on the boat, the boatman uses a boat hook to grab the rope. The user holds onto the rope. Now the user must judge the maximum point of upward motion of the boat, grab the rope and swing to the platform. It is absolutely essential that the swing not be attempted until the boat is at the maximum upward point of travel. (This patent attorney has often arrived on his back sliding along the landing area of the platform due to misjudgment of upward travel.) The real danger in this operation is caused by pure misjudgment. If misjudgment occurs, the "swinger" returns to the boat, which may be coming up and hit the person on the rope. BUT, worse, the "swinger" might be caught between the boat and the platform—death or severe injury will occur!

At present the only other means of safety entering or leaving a platform is by gangway, helicopter or by a man-basket that is operated by a pedestal crane. In the case of a man-basket, usually the crane operator is unable to visualize the man-basket as it is lowered below the main platform, which may be seventy-five feet above the water surface. A flagman must attempt to direct the lowering of the man-basket onto the workboat. At times the man-basket is dropped onto the boat deck with such force that the transferring workmen are injured. It is very difficult to synchronize the man-basket movement with the vertical movement of the boat because of the lag in communication between the crane operator and the flagman.

The prior varies from gangplanks or gangways, through man-basket systems, to complex elevator systems that require special attachment points on the workboat. The first offshore oil production occurred in about 1948 in shallow water just offshore from Louisiana. As production pushed further offshore the problems of a swig rope became more apparent and the prior art—for offshore platforms—essentially started at that time. Pitts et al., U.S. Pat. No. 2,641,785, disclose a Marine Transfer Ramp, which is designed to couple into an attachment point on a boat. It is interesting to note that the inventors worked for an oil company and the application was filed in 1948. Winfrey et al., U.S. Pat. No. 3,064,829, disclose a marine Transfer System, which is essentially an elevator system employing counterweights and a special attachment point on the boat. Mizzel, U.S. Pat. No. 3,426,719 discloses a Marine Transfer Device, which is essentially a hydraulically controlled gangway designed to couple onto a boat. Mizzel is but one of many gangway or gangplank devices. These devices, although useful, are expensive and have not found use, except during the construction phase, on offshore platforms. Williams, U.S. Pat. No. 4,590,634, discloses a Marine Transfer Device, which is similar to that of Mizzel except that a platform based crane is used to operate and position the gangway onto a workboat.

True et al., U.S. Pat. No. 2,876,919 disclose a marine Transfer Device, which is designed to interactively couple between a platform and a workboat. The device requires special equipment on both the workboat and the platform. The equipment is complex and would be expensive to install on every platform. Walker, U.S. Pat. No. 2,963,178, discloses a Marine Landing Assembly, which is another elevator type system designed to attach to the platform and move personnel and equipment between a boat and the platform.

Other variations of the gangway system may be found in the disclosures by Anders, U.S. Pat. No. 4,601,253 and Smedal, U.S. Pat. No. 4,369,538. Anders discloses an Offshore Boarding Apparatus, which is a ladder device operated from the platform. Smedal discloses an Apparatus for Transfer of Persons and Goods between Structures Offshore, which is a tubular bellows like gangway operated from the platform and requires special attachment points on the workboat.

Kanady et al., U.S. Pat. No. 2,963,179, disclose a Marine Transfer Assembly, which is based about a floating boat ramp into which the workboat latches. The ramp is lowered from the platform by a winch/crane.

Some prior art may be found in escape systems for offshore platforms. These systems are really designed to allow personnel to leave the platform under emergency conditions and would not allow for dual egress. Aanensen, U.S. Pat. No. 4,602,697, discloses an Escape Means for Sea-Based Construction, which is a gangway device, operated from the platform that terminates in a rubber slide.

The prior art then turns to man baskets or cages, which may be controlled from the platform. Rees, Jr., U.S. Pat. No. 2,874,855, discloses a Personnel or Object Transfer apparatus and Method, which is essentially a man basket operated from the platform. The man basket moves up and down about a guide cable. The guide cable attaches to a point on the boat and moves with the boat motion. An operator is required on the platform.

Stair, U.S. Pat. No. 4,180,362, discloses a System to Transfer Cargo or Passengers . . . The system uses a man-basket controlled from the platform that interacts with a constant tension winch on the workboat. Although the system will allow for the safe transfer of men and materials, an operator is required on the platform and a complex system must be installed on both the workboat and the platform. MacDonald et al., U.S. Pat. No. 4,395,178, disclose a Transfer System for Use between Platforms . . . , which is a modification of Stair. MacDonald requires similar special equipment on both platform and workboat and operators at both sites.

Kimon et al., U.S. Pat. No. 4,412,598, disclose a Personnel Transfer Apparatus and Method, which uses a man-basket operated from the larger object. The larger object is a ship, although the device could be used on a platform. Again an operator is required on the platform. The base disclosure goes to an apparatus and method for balancing the vertical motion of the man-basket while in contact with the workboat (or tender).

Peyre et al., U.S. Pat. No. 4,630,542, disclose a Nacelle, which may be used to transfer men and equipment between a platform and a workboat. The device is somewhat complex and requires a crane (and operator) on the platform. The nacelle is internally powered and couples itself about a cable attached between the crane hook and the workboat. An internal hydraulic tensioner, within the nacelle, takes up the relative motion between the workboat and the platform. There is a limit to the amount of relative motion that may be absorbed by the device, and in rough seas the device would be limited. Strong et al., U.S. Pat. No. 5,713,710, disclose a Transfer System, which is similar to Peyre, except that there is no hydraulic tensioner to absorb relative motion and all control rests in the platform crane operator. Relative motion between the platform and the workboat is absorbed by a "bungee cord."

Finally, the prior art contains two interesting devices. Henderson, U.S. Pat. No. 4,166,517, discloses a Pilot's Power Elevator, and Peyre, U.S. Pat. No. 4,739,721, discloses a Boat for Vertical and Horizontal Transfer. Henderson solves the transfer of a pilot between a pilot boat and the ship using an elevator system operated from the ship. Peyre, on the other hand, proposes a self-powered miniature boat that may raise and lower itself from a larger vessel or a platform to a workboat or the water. However, attachment to the platform requires an operator on to the platform.

All of the prior art requires an operator on the platform to which egress is required by personnel (and materials) on the workboat. Very often the seas are too rough to use either the Swing Rope or crane to transfer men from the boat. This presents a serious maintenance problem since many platforms require daily visits by a production worker. In daily operations, men and equipment are transferred between platforms that (in the vast majority) have no personnel in residence; thus, there are no operators available to make the initial transfer between vessel and platform. It should also be noted that at the end of working day, nobody could be left on the platform to operate any egress equipment. Finally and based on the inventor's experience, a system that uses off-the-shelf devices is required.

Therefore and because of the need for a dependable and safe method of transferring workmen from the boat to the platform without the need for operators on the platform, the instant invention was developed. At present, there are about 4,000 platforms operating in the Gulf of Mexico. Each of these platforms needs an effective and safe personnel transfer system. Worldwide there are some 100,000 platforms.

SUMMARY OF THE INVENTION

The instant invention is designed to operate in eleven-foot seas and high winds. The key to the design, which prevents injury to the transferring workers, is that the system is raised and lowered by the workmen in the man-basket itself, who can easily judge the movement of the boat and coordinate the lifting or landing of the personnel carrier.

In the preferred mode, the instant invention is supported and positioned by a two-cable system. One cable attaches to the main deck of the platform some seventy-five feet (a usual standard on platforms) above the water level through a self-contained winch on the man-basket (later referred to as "the shuttle") itself The personnel carrier is moved up and down in a vertical mode. A second winch controls a cable, which transverses horizontally to the landing platform from the man-basket. After the man-basket is lifted vertically from the boat deck, the horizontal cable swings the man-basket over the landing platform where it is lowered to its store position.

To move from the platform to the boat the workman(men) enter(s) the man-basket and raise(s) the basket vertically upward. The horizontal cable winch is then utilized to allow the man-basket to swing to its neutral position on the vertical cable. The operator (workman(men)) then lowers the basket onto the boat deck, carefully observing the boat's movement.

The ability to timely lift the basket while the boat is rising on a sea swell, and lower it to a landing while the boat deck is descending, prevents an uncontrolled impact between the man-basket and boat. Moving from the boat to the platform is even easier. No concern is given to the motion of the boat. When ready, the instant invention is simply raised to three or four feet above the motion of the boat and then winched sideways to the landing platform.

DESCRIPTION OF THE PREFERRED EMBODIMENT

Figure 1:
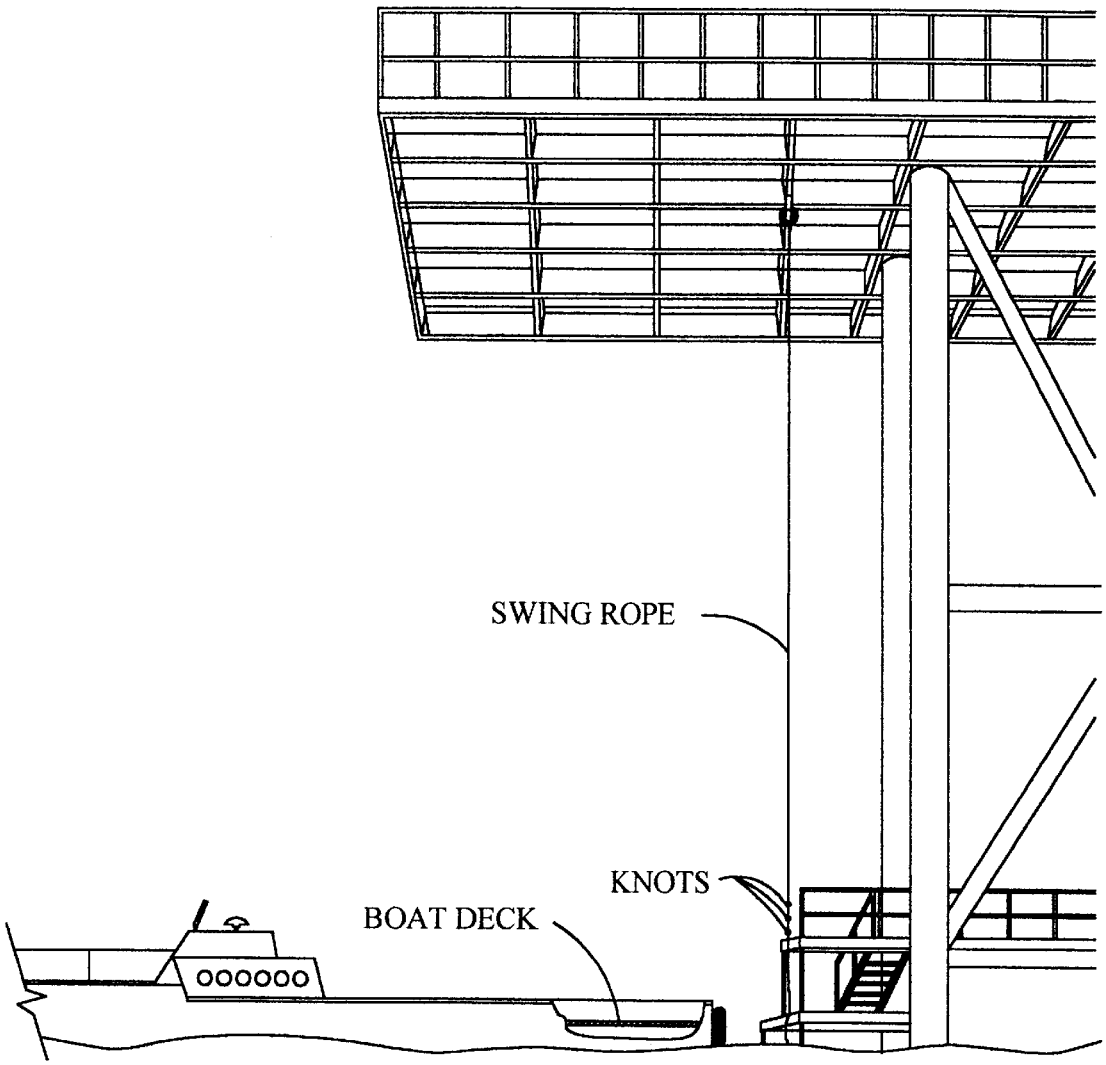
FIG. 1 shows the prior art "swing rope" system utilized on most offshore platforms.
Figure 2:
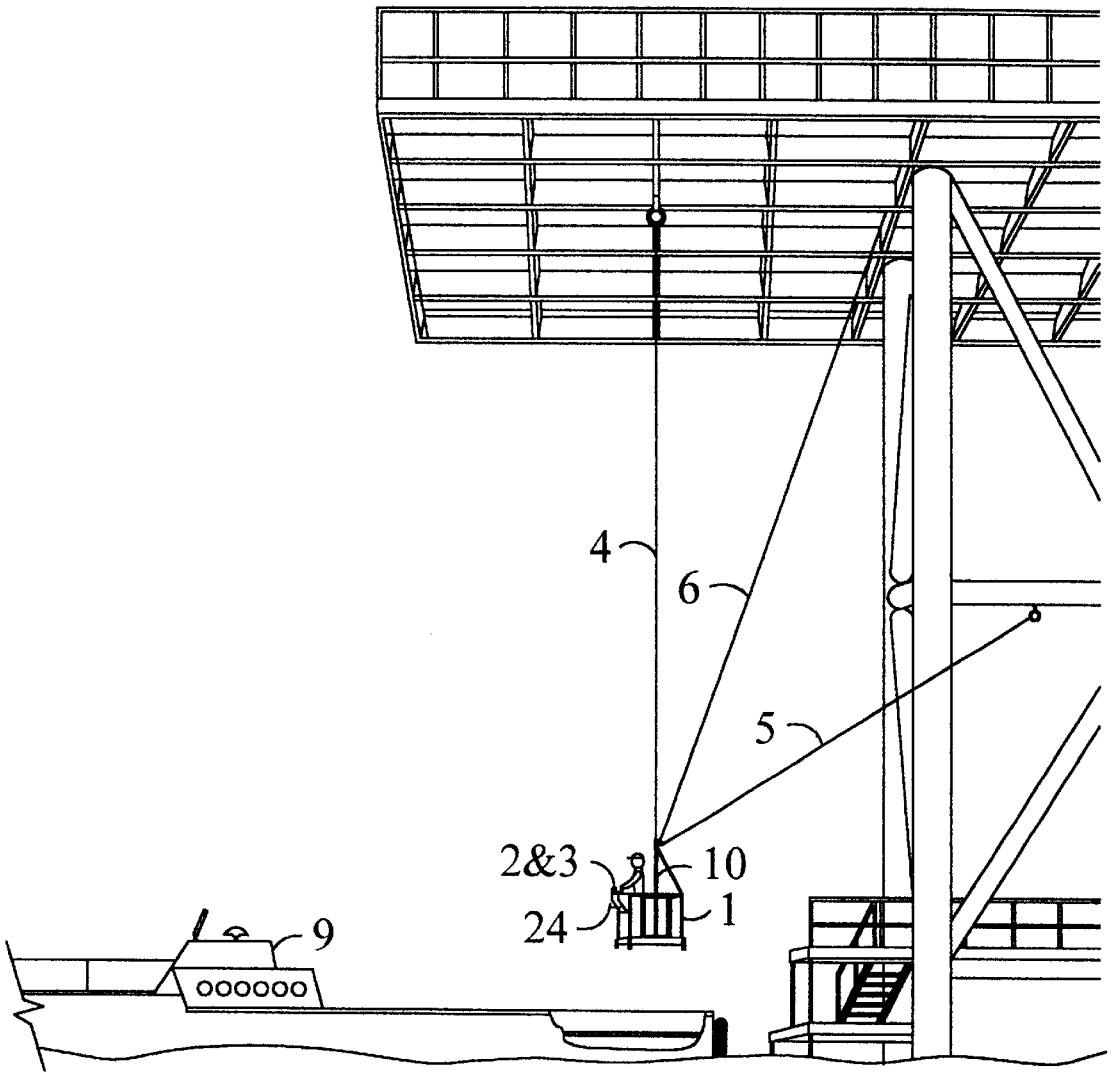
FIG. 2 is an artist's rendition of the major components of the instant invention. The view shows the man-shuttle of the instant invention over the back of a workboat.

Referring to FIG. 2, the instant invention is based about a man-basket, 1, (hereinafter referred to as the "shuttle"), which contains all the controls, 2, and power winches (11 and 12, see FIG. 5) required to operate the system. There are two cables associated with the system: the primary or hoist cable, 4, and the secondary or lateral cable, 5. The hoist cable (vertical cable, 4) runs from the top deck (or a convenient support frame) of the platform to the shuttle, 1, and provides up and down movement for the shuttle. The lateral cable (horizontal cable, 5) runs laterally from the shuttle to the platform terminating at a convenient point over the landing area of the platform. This cable provides lateral (in and out) movement for the shuttle. Both cables run through a central conduit on the shuttle, 10, and terminate on separate winches in the base, 13, of the shuttle. (See FIGS. 4 and 5.)

The hoist cable (vertical cable) is ⅜" stainless steel with a maximum capacity of 12,000 pounds (ten to one safety factor). The lateral cable for horizontal movement is ¼" stainless steel and has a maximum capacity of 4,000 lbs.

In the preferred embodiment, an air (or gas) hose, 6, stored on a spring loaded hose reel (not shown), provides energy to two cable winches located in the base of the shuttle. The hose reel is preferably mounted to the underside of the top deck (or a convenient support frame) over the landing area on the platform.

Controls, 2 and 3, for the two winches are preferably located on the shuttle although a secondary controller (not shown) may be suspended on a spring loaded cable reel such that, when it is retrieved, may be used from the deck of the workboat. Alternately, the controls could be demountably attached to the shuttle with a means to assure that the controls can operate away from the shuttle and return to the shuttle when released by the operator. This is really a design choice, but the preferred mode envisions the controls mounted on the shuttle.

Control parameters for the Offshore Personnel Transfer System are movement and float. Movement involves two control handles, 2 and 3. Each handle moves fore or aft with a spring return to neutral. One control, 2, lifts and lowers (hoist mode); whereas, the other control, 3, provides the lateral movement in and out (lateral mode). A person in the shuttle operates the handles by hand, or by a boatman who utilizes a boathook, 8, to operate the controls via hooks 22 and 23. The float control, 14, is a means of disconnecting the driving means from the winch drums, allowing for free-wheeling of the drums and is engaged ONLY when the shuttle is on the deck of the workboat. (Float mode may be accomplished by reduced motor torque rather than complete disengagement of the winches from their drive motors.)

The float mode can be active or passive. An active system uses a second set of drive motors attached to each winch for providing a reduced torque at will allow the winch to reel in and out as the boat moves up and down or side to side. In the case of electrical drive, the winch motors would have a reduced torque setting that would accomplish the same ends as described above. A passive system would use a set of counterweights, which will be explained in the alternate embodiment.

The Offshore Personnel Transfer System is preferably operated by a pressurized gas, either air or natural gas at an operating pressure of about 100 PSI. The gas or air supply hose, 6, is at least ¼" I.D., and, as stated, is stored on a spring operated reel located on the platform deck. The preferred embodiment uses compressed air supplied by a compressor located on the platform. This compressor can be driven by an electric motor, a fluid driven motor (natural gas), or similar means. It would be possible to use hydraulic winches powered by a hydraulic pump located on the platform. The pump would be powered by a similar means used to power an air compressor. It would also be possible to use DC or AC electric motors to drive the winches and provide tension in the float mode. An electric power cable, stored on a spring-loaded reel, would replace the air hose.

In reality the power source depends on the specifications of the platform operator and local safety regulations. Regulated natural gas, usually available on unmanned platforms, can safely be used. In a pinch, the exhaust gas could be taken back to the platform, via a second self-reeling hose, and exhausted at a safe point on the platform. Thus, the actual choice of operating power must be determined by the end purchaser and the system must be capable of adapting readily to the desires of the purchaser.

Figure 3:
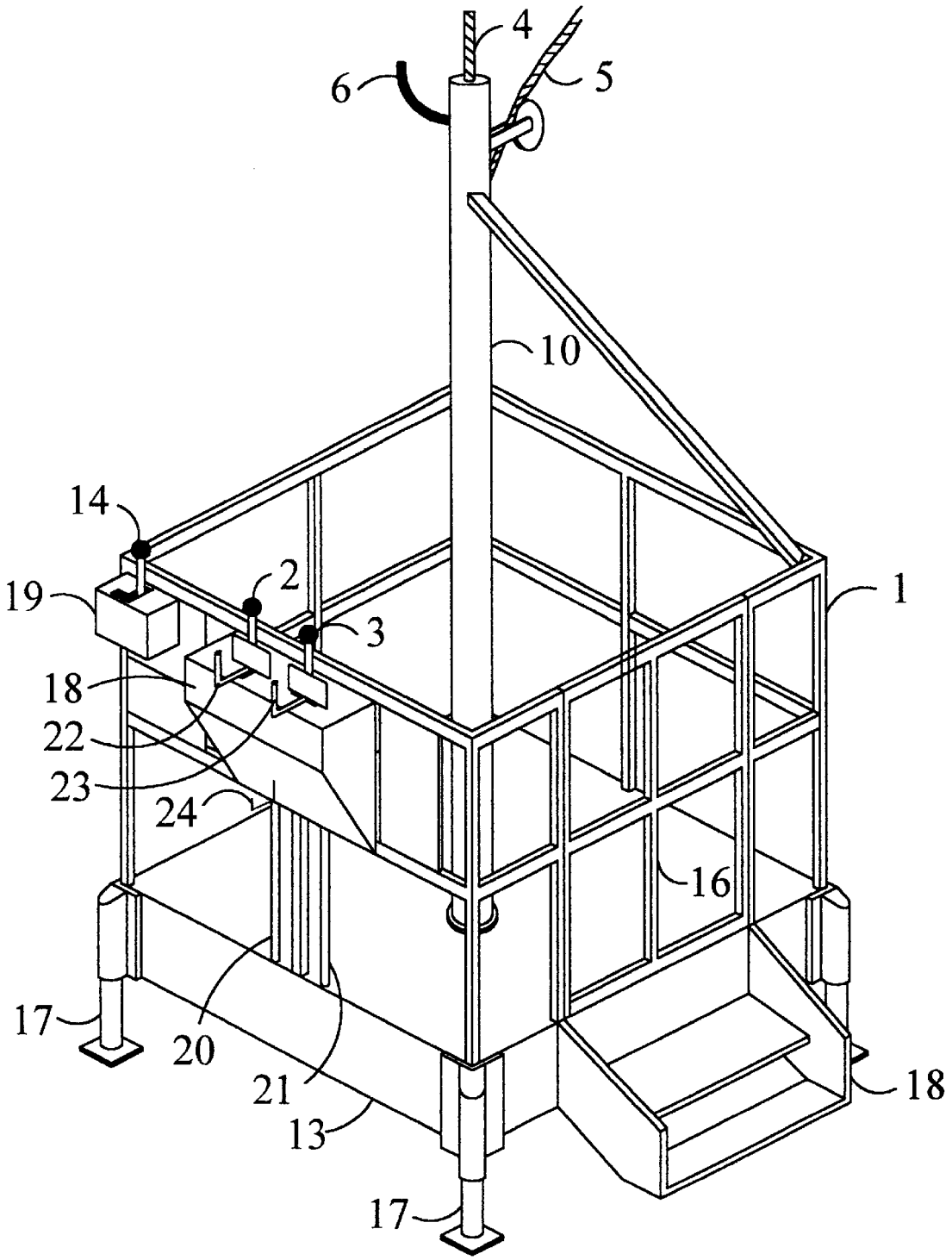
FIG. 3 shows the major components found on the man-shuttle of the instant invention including the control levers.

Referring to FIG. 3, the shuttle, 1, is constructed from aluminum with an entry door, 16 and space for three workers. Although not shown, a standard four-inch toe board surrounds the floor plate. (The position of the toe plate is indicated by dashed line 15 in FIG. 4.) The toe board is important for safety, because the Offshore Personnel Transfer System will transport pipefittings, tools, batteries, instruments, and many other maintenance and construction materials. The vertical and horizontal cables pass through a cable-tube. The air hose attaches to the cable-tube and is routed to the motor/winch compartment.

The air motor/winch compartment, which is essentially the shuttle base, 13, (see FIG. 5) under the floor is watertight and vents through the cable-tube or central conduit, 10. (If natural gas is used as a source of power to the winches, the exhaust gas can vent through the cable-tube or through a second fluid hose attached to the cable-tube.) Finally, the legs of the shuttle, 17, contain springs and shocks to assist in "soft" landing on the workboat.

Figure 4:
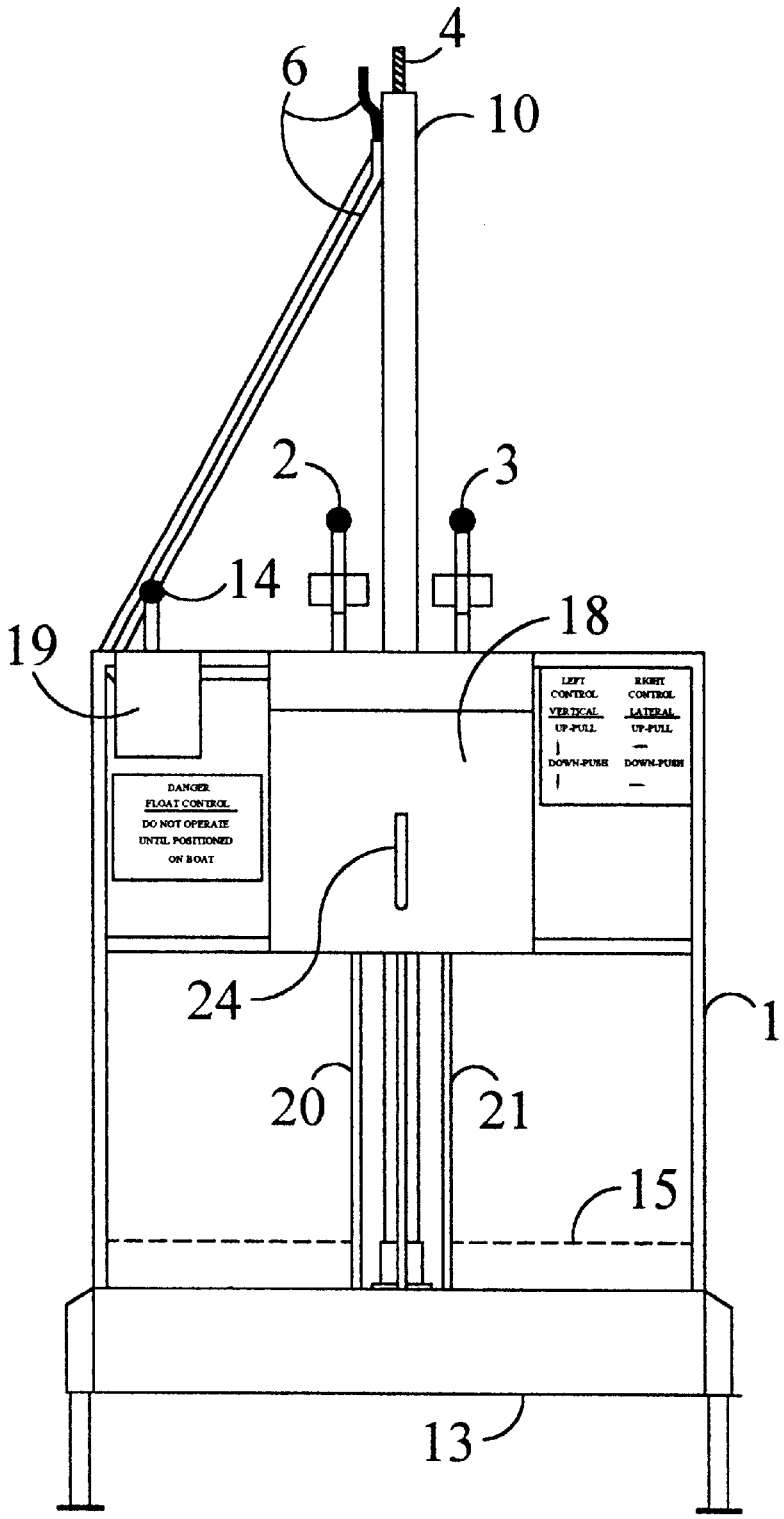
FIG. 4 further shows the system controls found on the man-shuttle along with proposed warning and instruction placards.

FIG. 4 shows placard details and other details for the system controls. In the case of fluid controls (which includes air, natural gas or hydraulic power) the motion control knobs, 2 and 3 would be connected to fluid valves within the outer housing, 18. Fluid power enters by way of hose 6 and is distributed to the two motion control valves. The output from the valves travels down lines 20 or 21 to the respective winch 11 or 12. Vent gas from the two winches would travel up the central conduit or cable-tube, 10, and exhaust at the top of the tube. If safety considerations do not allow venting (or in the case of hydraulic winches) a second (or the required number hoses needed by design) would travel back up the central conduit and onto the platform via a spring-loaded take-up reel mounted on the platform. (Again this choice is up to the design engineer and would be made to meet the requires of the platform operator.)

Figure 5:
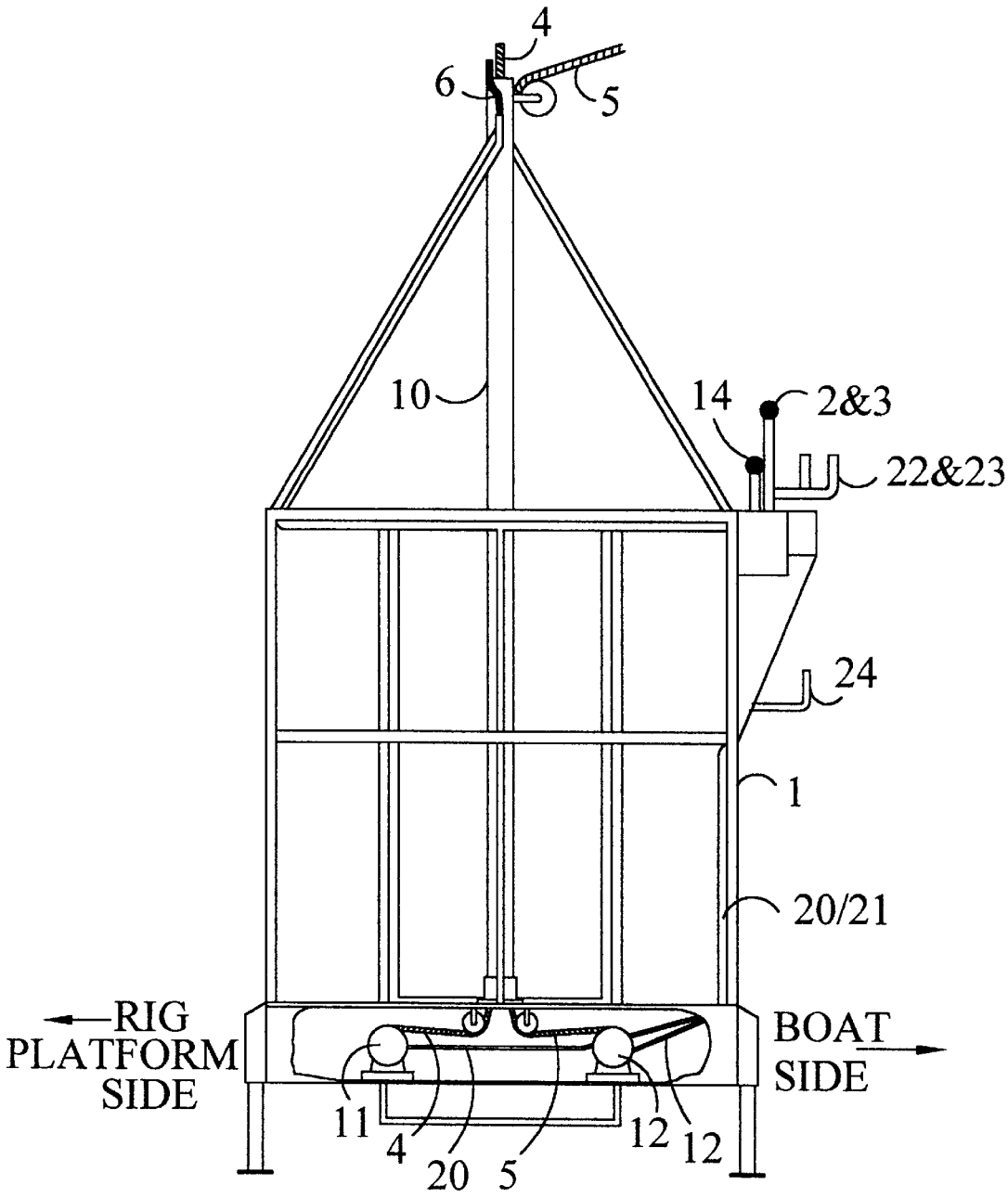
FIG. 5 shows the preferred winch power system for the instant invention, which is located on the man-shuttle.

FIG. 5 shows details of the fluid winches. Two fluid (or electric) operated, reversible winches provide movement for the shuttle. A two-position valve, within the control housing, provides forward and reverse movement with a spring return to neutral for each winch. The valves are in actuality the two movement controls (2 and 3) shown in FIG. 3. Fluid power from the control valves/knobs passes through lines 20 and 21 to the respective winch. If electric power were used, the same routing would be used. As stated earlier, it is a matter of design choice set by the operating parameters of the platform on which the shuttle system would be installed.

Not shown are the preferred low torque fluid motors provided on each winch to remove slack from its respective cable by maintaining tension in the cable to eliminate slack as the motion of the boat travels vertically and horizontally. These motors are engaged by the float control, 14. The "float" control releases all winches from the drive motors, allowing free rotation of each drum while keeping tension on the lines. (Remember electric motors can replace the fluid motors and a low torque setting on the electric motors could readily accomplish the float mode.) It may be possible to have a control scheme that allows the fluid drive motors to have a low torque setting, which would also accomplish the float mode. A symbolic diagram showing the interaction between the float control and the four drive motors in shown in FIG. 15. It should be noted that the diagram applies to both fluid and electric drive motors.

Figure 15:
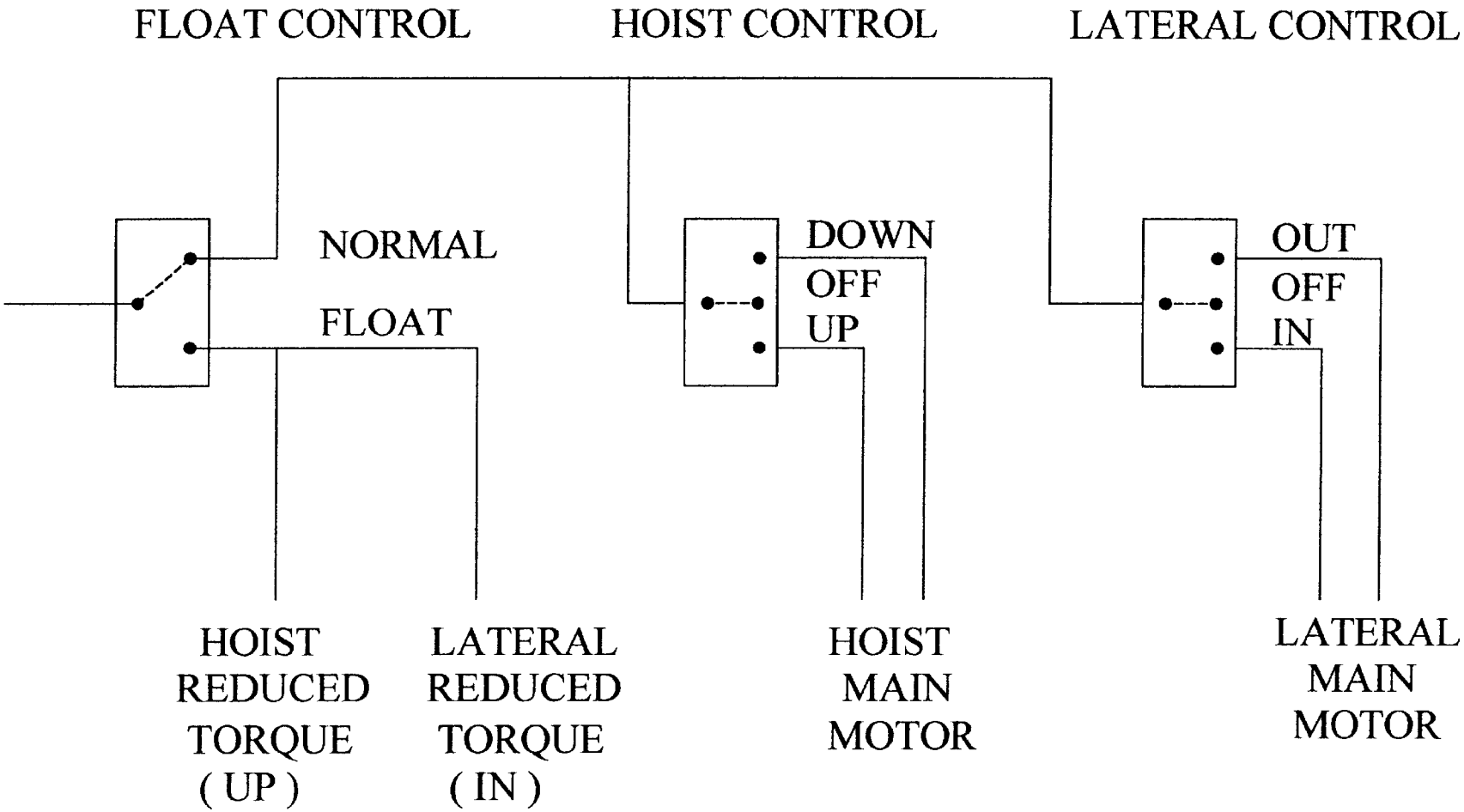
FIG. 15 is a symbolic diagram showing the interaction between the Float Control, the Hoist Control, and the Lateral Control for use with two main motors and two reduced torque motors.

FIG. 15 shows that control power enters the Float Control and is normally passed to the Hoist Control and the Lateral Control. If the Float Control is in Float, then power is not passed onto the Hoist and Lateral Controllers and the normal action of the winch is inhibited. In Float, power is passed to the reduced torque motors which maintain constant tension on the cables, while allowing them to spool of the winch with the vessel's motion. As regards the hoist and lateral controllers, note the center-off position.

Figure 14:
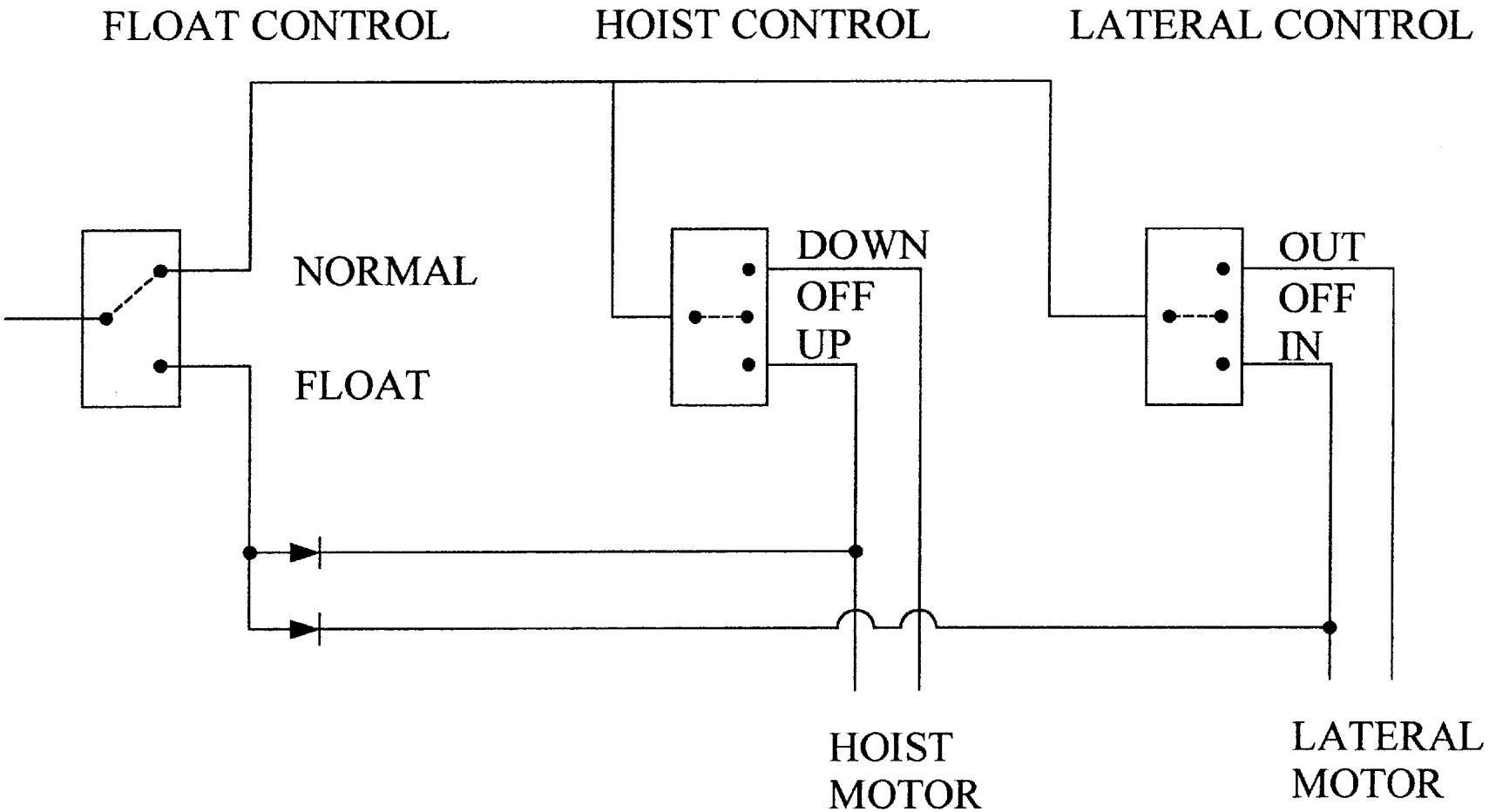
FIG. 14 is a symbolic diagram showing the interaction between the Float Control, the Hoist Control, and the Lateral Control for use with two winch motors.

FIG. 14 shows an alternate float control scheme that utilizes only two winch motors. Here power still enters the Float Control is sent to the Hoist or Lateral Control in the normal mode. In the float mode reduced power is sent to the "up" and "in" side of the hoist and lateral motors respectively. This causes both motors to pull its respective cable into the shuttle while allowing the vessel's motion to drag the cable from the winch as needed. This system maintains a constant tension on the respective cables. The technique can be adapted to work with both hydraulic and electric drives.

Figure 6:
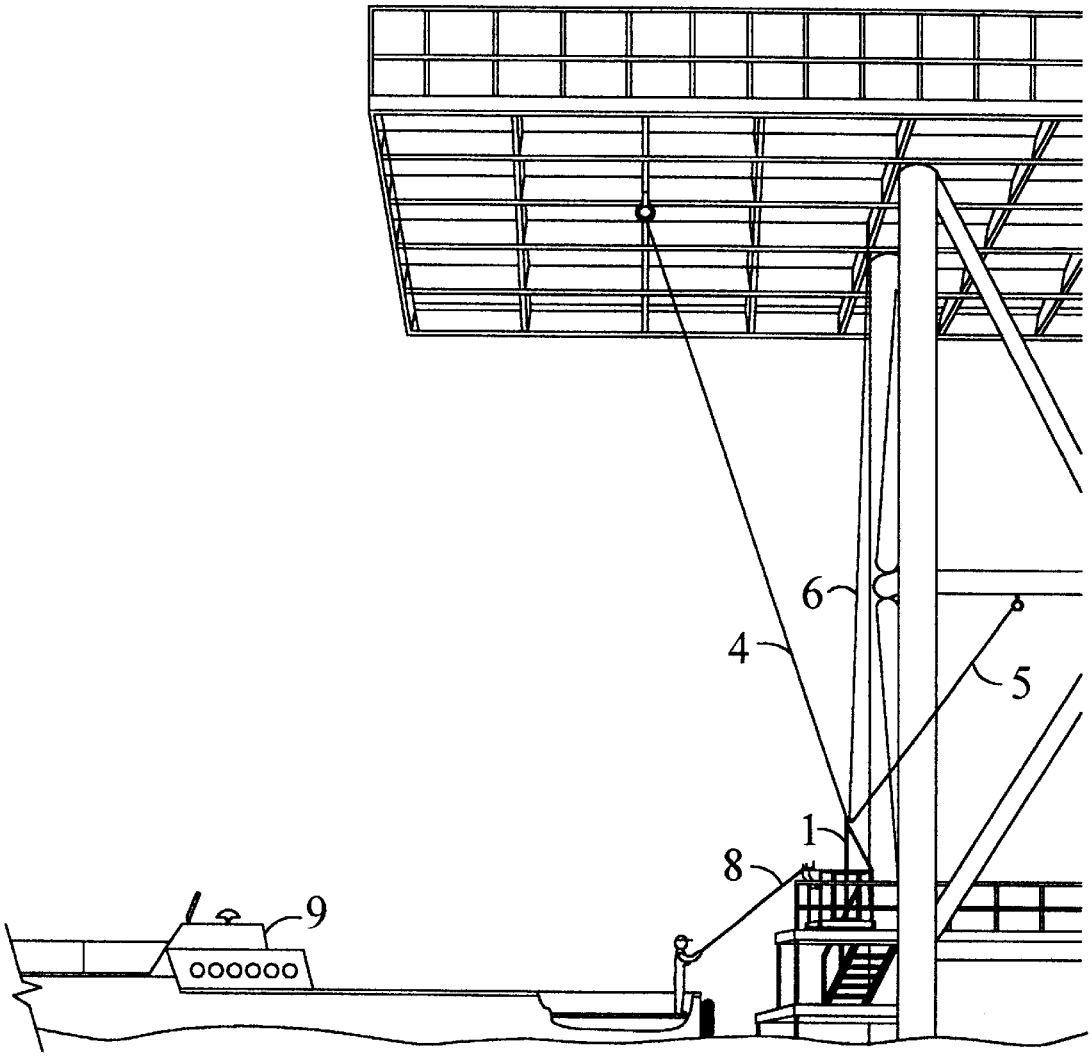
FIG. 6 shows the method by which a boatman retrieves or returns the man-shuttle to its platform.

FIG. 6 shows the preferred method of retrieving or returning the shuttle to its platform when there is no operator in the shuttle. There are many means of "calling" and "retrieving" an unmanned shuttle between the boat and platform. A secondary control (not shown) could be provided which connects to the shuttle and is suspended above the boat on a counter weighted cable. The boatman could utilize a boathook to snare the control and pull it down for convenient operation. This second control would be independent from the controls mounted on the shuttle. Another system could involve a radio frequency, an infrared or an ultra-sound hand held device (similar to a garage door opener) to control the shuttle.

As stated, the preferred embodiment for operating an unmanned shuttle, utilizes a boathook, 8, (which is available on all work boats) to physically operate the control levers on the shuttle. This system is much superior in that the cost is less and the simplicity increases the reliability of the shuttle operation. The boatman would use his boathook to pull on the up/down boathook point, 22, which would raise the shuttle up from the landing. He would then pull on out/in boathook point, 23, to allow the shuttle to swing out towards the boat. He would then push on the up/down boathook point, 22, to lower the shuttle onto the boat. An operator would then enter the shuttle and take over operation of the shuttle.

Figure 7:
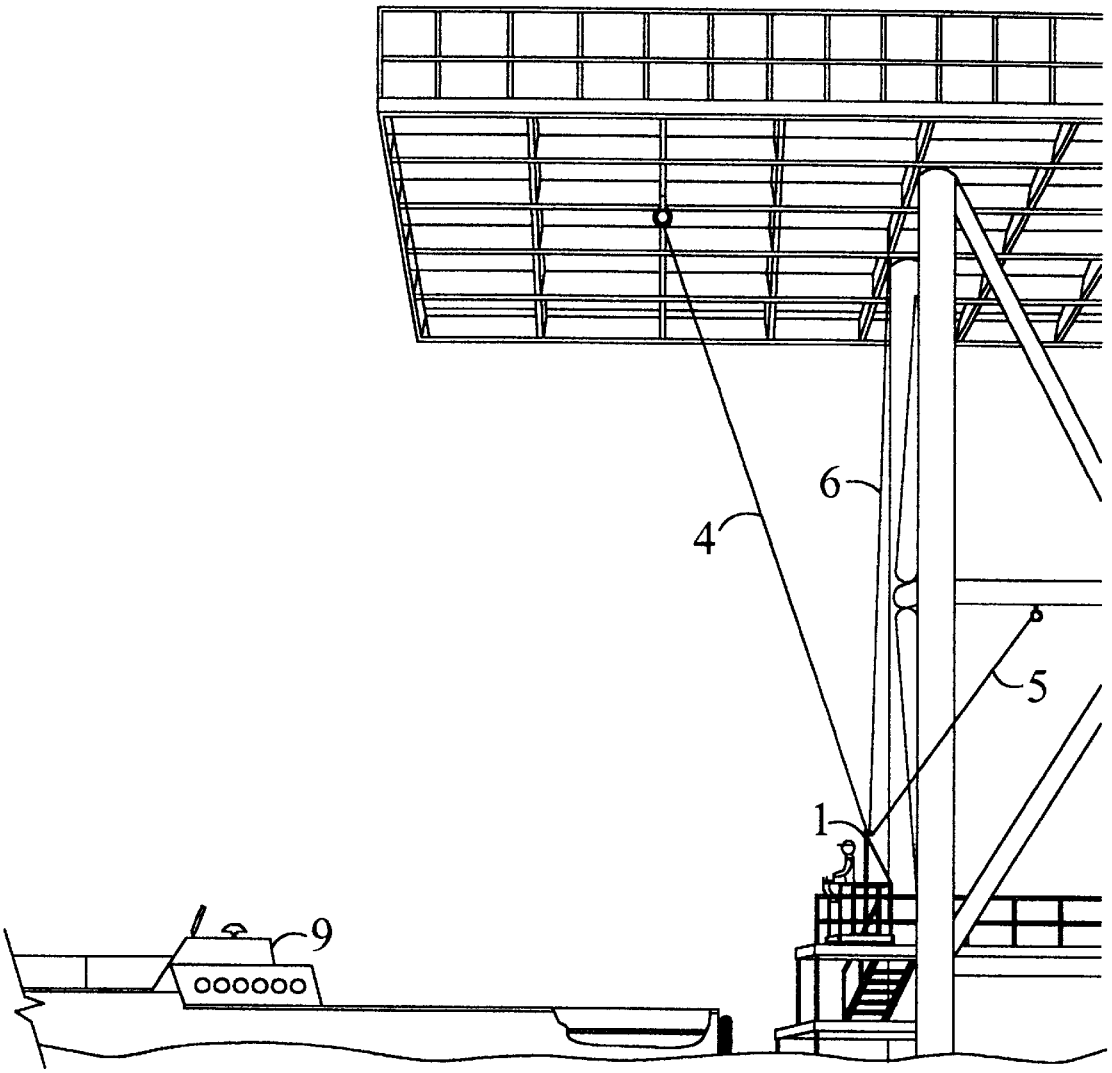
FIG. 7 shows an operator in the man-shuttle leaving or returning to the platform.
Figure 8:
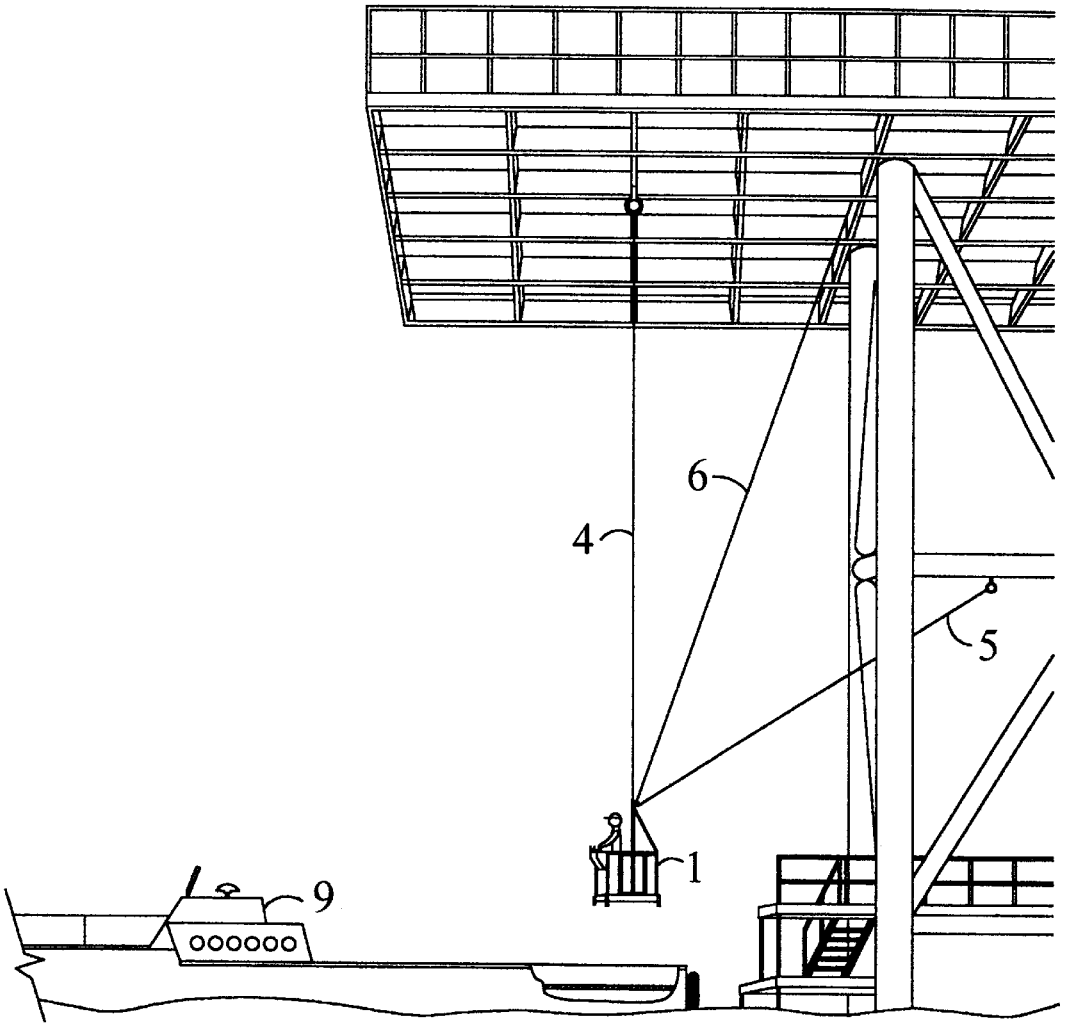
FIG. 8 shows the shuttle, with an operator, at its midpoint of operation.
Figure 9:
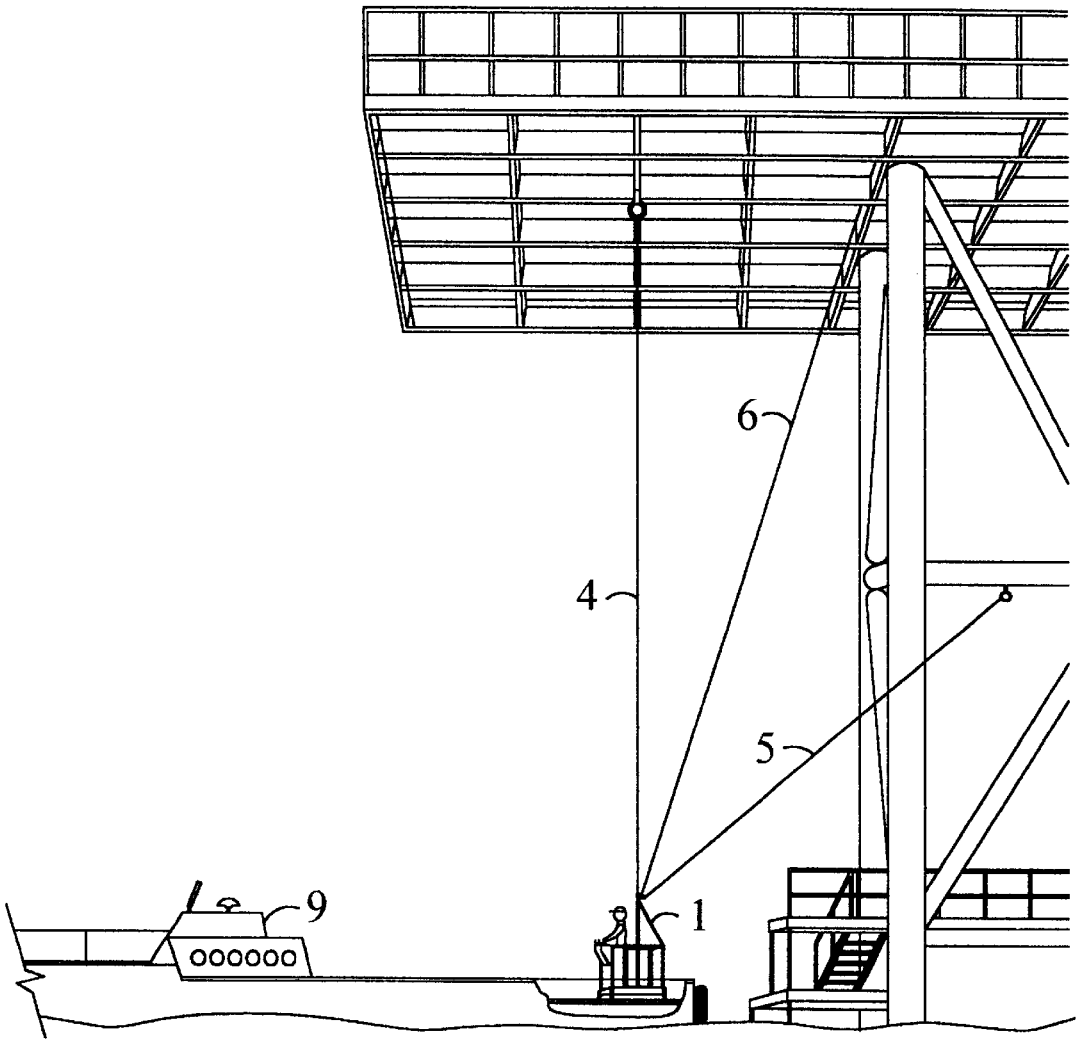
FIG. 9 shows an operator landing or leaving the workboat.

FIGS. 7 through 9 show an operator using the shuttle. The workman/operator would first place the float control, 14, in float. This allows the shuttle to move up and down and back and forth with respect to the platform while keeping the shuttle on the boat deck. When the workman is ready to leave the boat deck, he takes the system out of float and at the same time pushes on the lift control. This raises the shuttle up from the deck. The operator/workman would raise the shuttle far enough to make certain that the movement of the boat would not hit the shuttle. He would then pull on the lateral control, which in turn pulls the shuttle in over the landing. When the shuttle is over the landing, the operator/workman would lower the shuttle onto the landing. (These last two steps would normally be done in conjunction with each other by a skilled operator/workman.) It would be best to operate the vertical lift control at the point of maximum surge so that the boat "falls away" from the shuttle. Because of the available speed of the vertical lift, no special care is required in departing the boat. A safe departure can be accomplished at any condition of wave surge.

If a workman is on the platform and wishes to move to the boat, he enters the shuttle and operates the up/down (vertical) control to lift the shuttle a few inches above the landing platform. He then pushes the in/out (lateral) control to swing the shuttle out over the waiting boat. After moving the shuttle outward, the operator then begins to lower the shuttle, and at the same time adjusting the lateral position. As the boat deck is approached, the operator observes the vertical movement and rapidly lowers the shuttle as the boat reaches the maximum vertical position.

At the completion of work, the workman/operator return to the workboat and places the float control in float position. The boatman then uses a boathook to take the shuttle out of float. The boatman would then manipulate the up/down and in/out controls using boathook points 22 and 23 to return the shuttle to the platform.

The speed of the shuttle movement can be varied between zero and two feet per second, which is greater than the surge of any wave. Such a design allows for a very "soft" landing even in high seas. Once the shuttle operator lands upon the boat deck he immediately disengages the winches with the "float" control lever. From this point on, the boat can move up to twenty feet vertically and fifty feet laterally without dragging the shuttle on the boat deck.

It is important that the shuttle be able to "float" up and down with the motion of the workboat whenever the shuttle is on the deck of the boat. The preferred low torque motors will allow for "float" while maintaining cable tension. It should be noted that control techniques exist that would allow the main winch motors to operate in a reduced torque mode.

Figure 10:
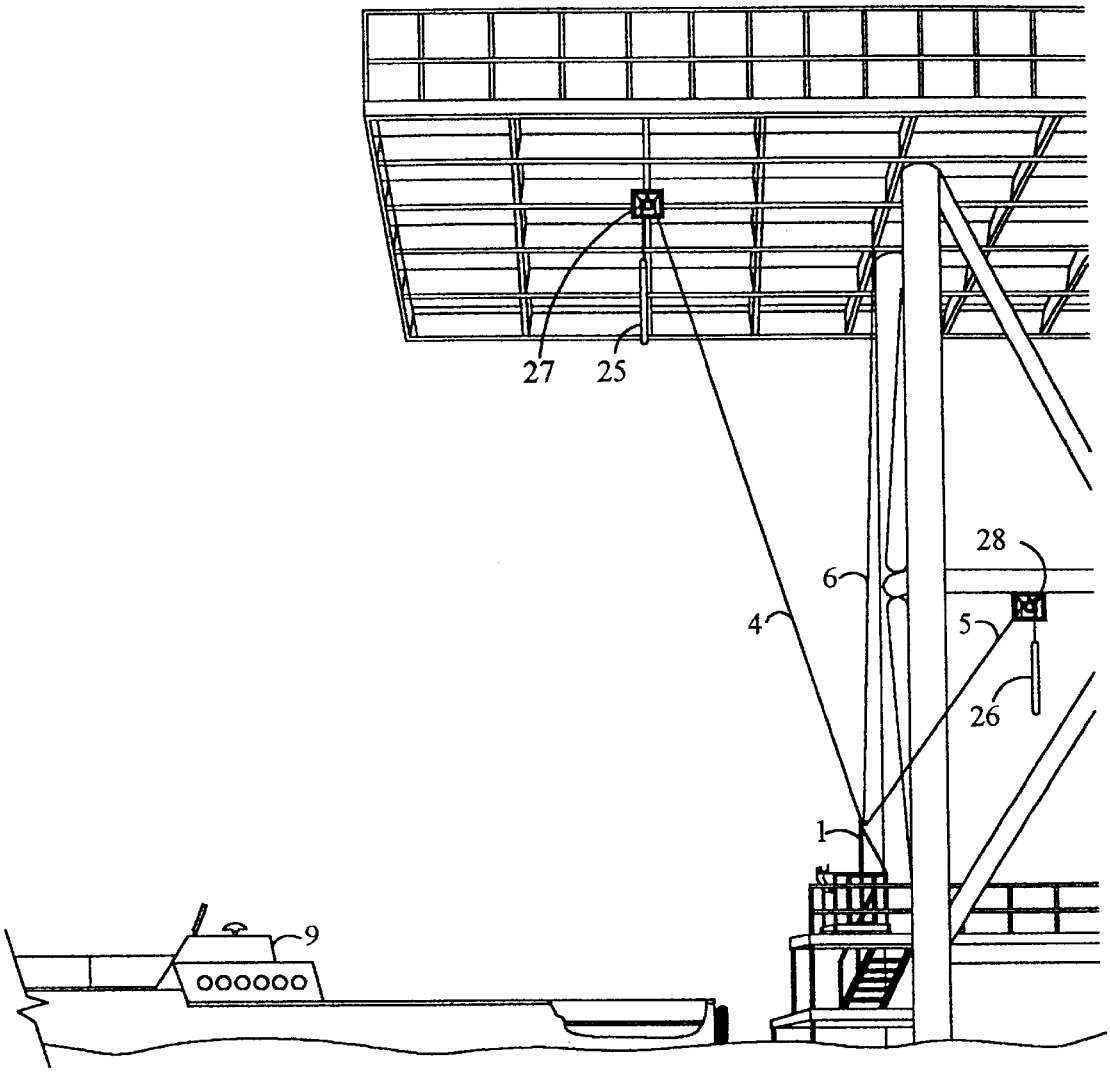
FIG. 10 illustrates an alternate method (passive) to keep the system cables under tension using counterweights and showing the man-shuttle in position on the platform.
Figure 11:
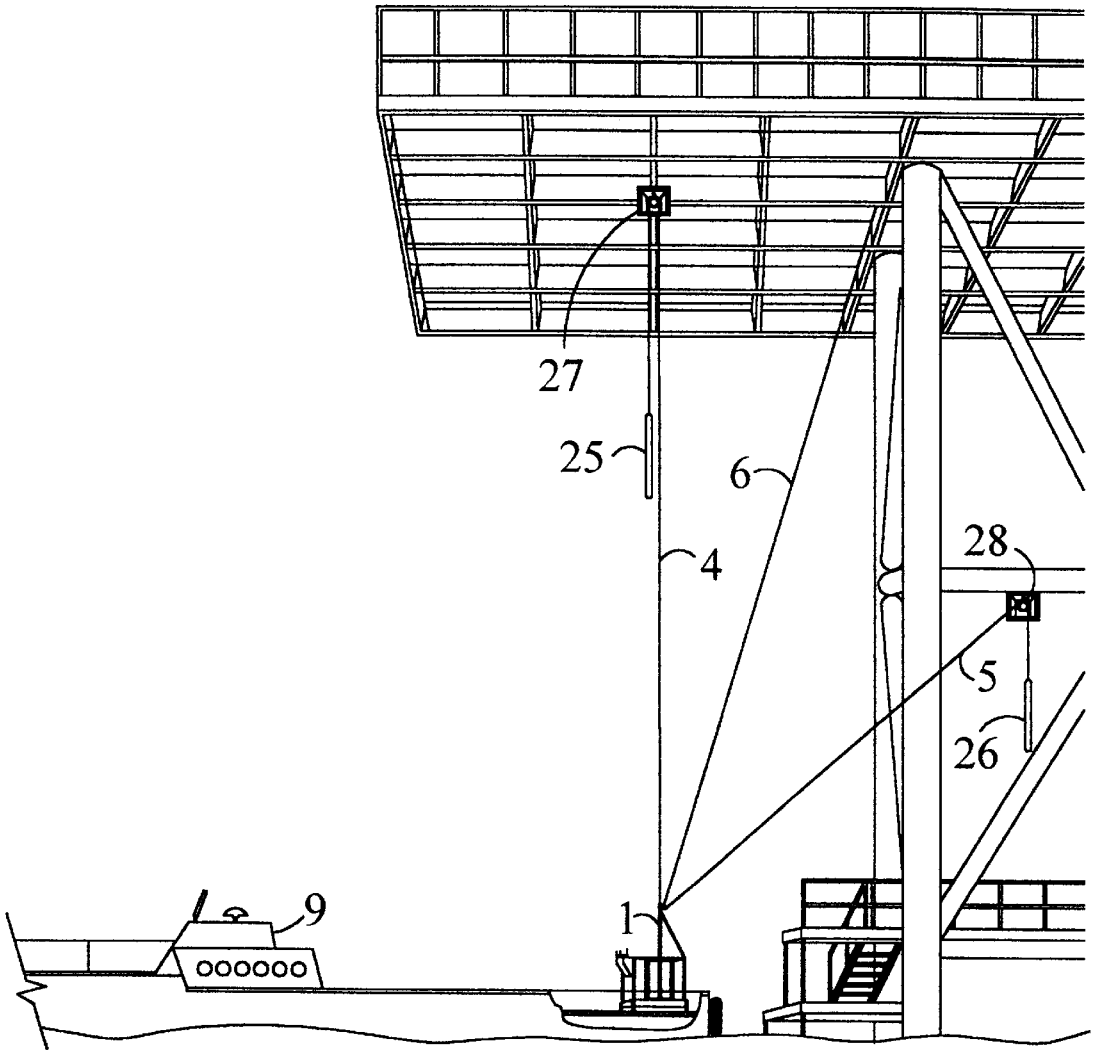
FIG. 11 is the same as FIG. 10, except the man-shuttle is resting on the workboat.
Figure 12:
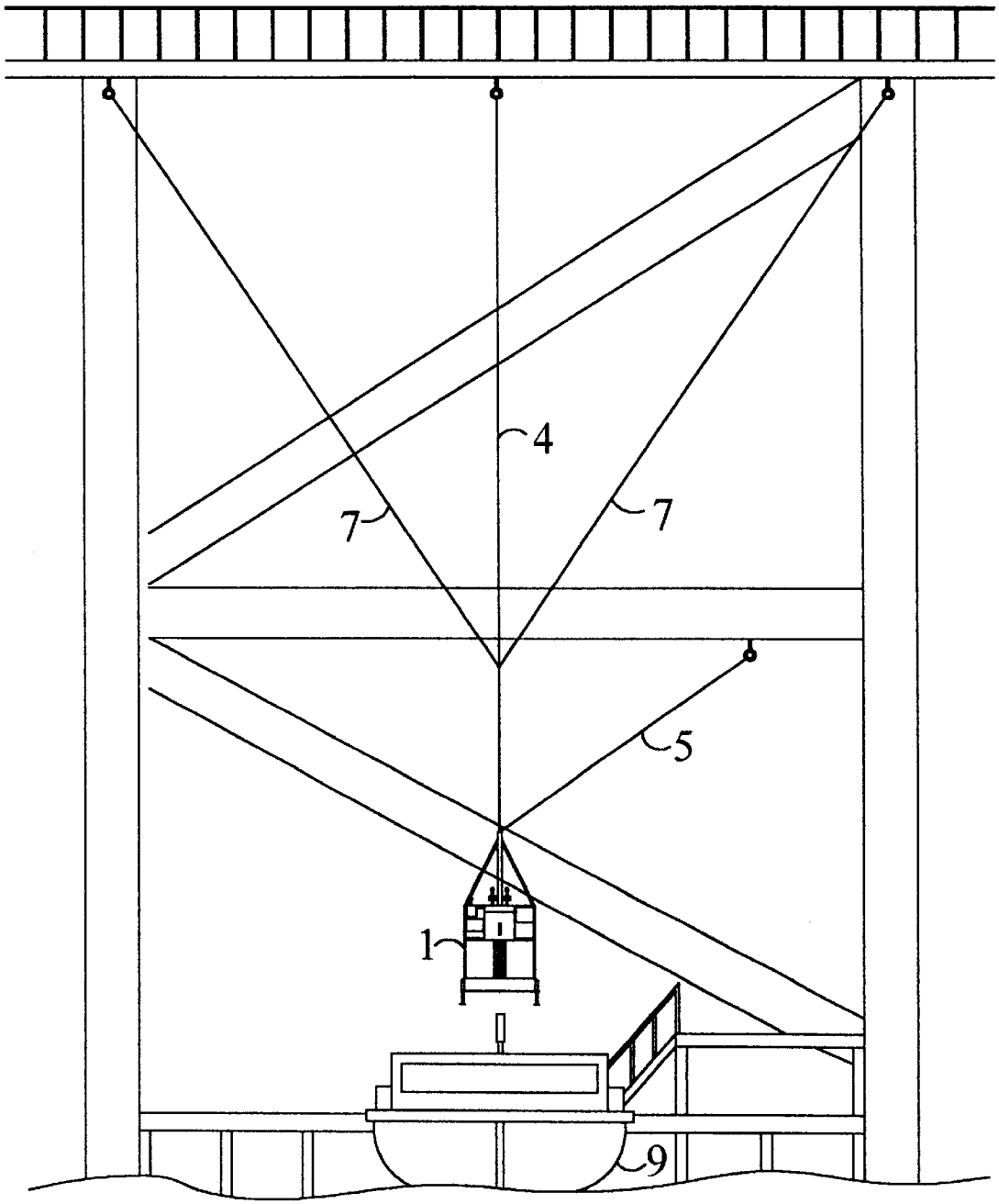
FIG. 12 shows an end-on view of two ancillary cables used to minimize side sway of the man-shuttle.

In the alternate cable tensioning/float mode embodiment, counterweights are installed at the dead-end (platform end) of the vertical and horizontal cables as shown in FIGS. 10 and 11. At all times other than when the shuttle is resting upon the boat deck, the counter-weights will be at or near the full "up" position (FIG. 10). FIG. 11 depicts the counter-weights lowered to provide "slack" as the boat is moved by the surge of the sea. The alternate cable tensioning system is less desirable than a "float mode" built into the winch system, but is a viable alternative design.

FIGS. 10 and 11 show an alternate design for maintaining cable tension in the vertical, 4, and lateral cables, 5. Tension is maintained by counterweights. The vertical counterweight, 25, is chosen to equal the weight of the shuttle; whereas' the lateral counterweight, 26, is considerably less than the vertical counterweight. A mechanical engineer can readily determine these valves during the design phase. Tension must be maintained in these cables in order to assure smooth operation of the shuttle when leaving the "stopped" position, in particular, on the workboat deck and the platform. (Maintained cable tension on the platform will restrict cable movement under windy conditions whenever the shuttle is "parked" on its platform.) The workman/operator or boatman depending on the use of the shuttle would pull the vertical counterweight up against the vertical pulley, 27, when lifting the shuttle from the platform landing or boat deck. Similarly the lateral counterweight would move against the lateral pulley, 28. When the shuttle is parked on the boat, sufficient cable would be run out to allow the two counterweights to take up all relative motion (see FIG. 11). As stated the preferred embodiment builds cable tension into the winch by a low torque motor.

Figure 13:
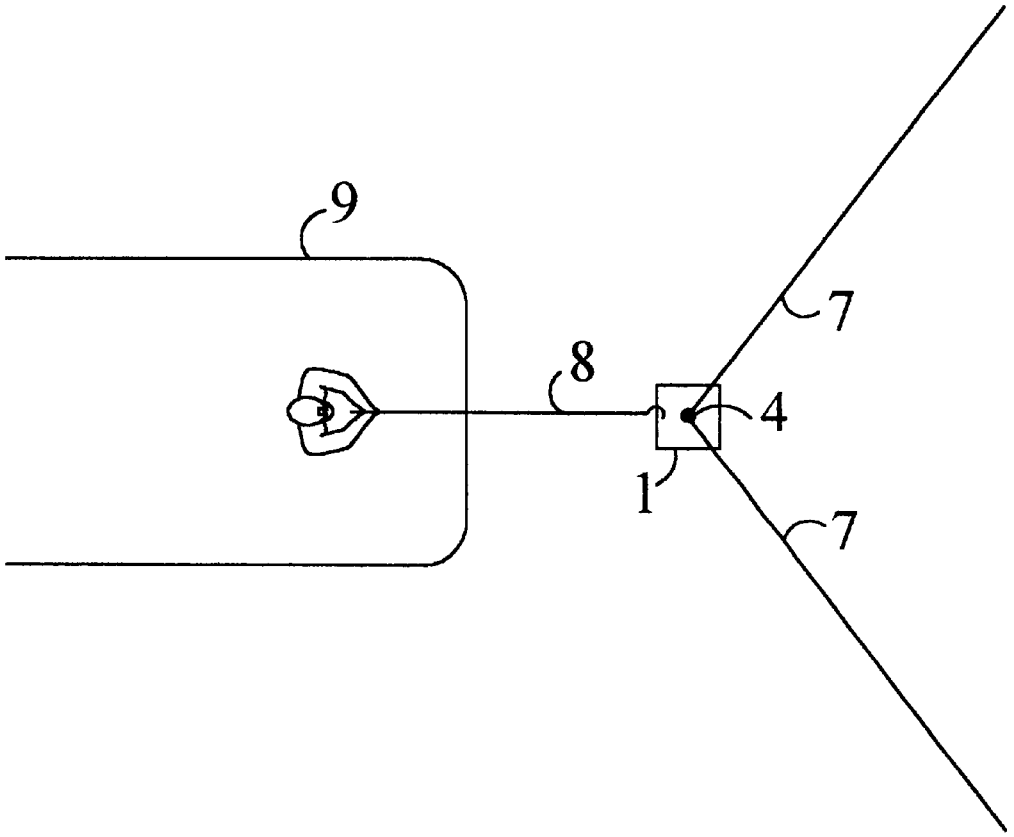
FIG. 13 is a plan view of the ancillary cable system of FIG. 12, showing the "three-point" sway minimizing method.

When suspended in the air, the shuttle is exposed to the pendulum effect caused by wind. This effect can be greatly reduced, if necessary, by providing diagonal cables, 7, to stabilize the vertical lift cable. The swing of the shuttle away from the platform is further limited by the lateral movement cable (see FIG. 13). To further assist control of the pendulum motion, a hook, 24, is, or may be, installed on the frame of the shuttle, just below the controls. The boatman can utilize his boathook to prevent inward movement of the shuttle while the lateral cable, 5, limits outward movement. Because of the small surface of the shuttle exposed to the wind, and the ability to move the shuttle rapidly, it is not likely that a detrimental swing of the shuttle would develop even without stabilizing cables.

It would be possible to supply power from the boat. Under these circumstances a quick connect fitting would be installed on the front of the shuttle, which normally faces the workboat. When the workboat approaches the facility, the boatman would use a boathook to stab the power cable (electric or fluid) into the quick connect. He would then retrieve the shuttle for use as previously described. After the shuttle has served its purpose and has been parked on the facility, the boatman would use the boathook to remove the power cable.

Another possible alternate would be to power the shuttle with storage batteries, and use electric motors. The storage batteries would hold a charge and allow the shuttle to be retrieved from the facility. After the shuttle has landed on the workboat, a charging cable would be attached to the shuttle and left in place while the shuttle was in use. The charging cable would power the shuttle and allow the storage batteries to recharge. At the end of the work period the cable would be disconnected, and the shuttle returned to the platform in the manner described.

Thus, there has been provided the best mode of an Offshore Personnel Transfer System and a number of useful alternates to fit a majority of conditions found in the offshore oil and gas environment. The instant invention readily fits any and all offshore platforms or rigs and provides a simple device and method for transferring personnel between workboats and platforms. The instant invention is a device:

1) that provides a means for combined vertical and horizontal movement;
2) in which all controls operate from the shuttle in transferring personnel from boat or platform;
3) in which the shuttle can be moved from platform to boat and return without assistance from platform personnel;
4) in which a common boat hook (available on all workboats) is all that is required to move and unmanned shuttle between boat and platform.
5) once docked on the boat, has a "float mode" which releases both winches, but maintains a minimum tension in cables;
6) in which the preferred hoist system is air operated but is designed to function with wellhead gas from the platform in emergencies, or for normal powering of shuttle, when desired;
7) which can be attached to platform by two cables plus an air hose for power and can be installed by two men in three hours;
8) which requires no special receiver or fittings on a boat;
9) which is designed to carry three persons and tools; and,
10) in which because it can be moved laterally at a low level to a landing platform on the structure, the personnel never have to be raised more than ten to fifteen feet above the water.

Most importantly the device provides an extra measure of safety in that personnel will not be caught between the boat and platform.

Any dimensions given in this disclosure should not be interpreted as a limitation and are provided as the best embodiment dimensions. These dimensions may be adjusted up or down to fit platform and boat requirements.

I claim:

1. A personnel transfer system for transferring men and materials between an offshore facility and a floating vessel that requires no specialized attachment points for receiving the transfer system comprising:

a shuttle;

first hoist means associated with said shuttle for operating said shuttle in a hoist mode which substantially raises or lowers said shuttle vertically with respect to the facility;

second hoist means associated with said shuttle for operating said shuttle in a lateral mode which substantially moves said shuttle horizontally with respect to the facility;

means associated with said shuttle for operating said shuttle in a float mode, said float mode substantially allowing said shuttle to follow the fluctuating motion of the floating vessel induced by wave motion when said shuttle is resting on the floating vessel;

power means for supplying power to said shuttle.

2. The personnel transfer system of claim 1 wherein said means for operating said shuttle in said float mode is passive and comprises:

two pulleys attached to the facility;

two counterweights;

a hoist cable having two ends, said second end thereof attached to said first hoist means associated with said shuttle wherein said hoist cable passes over first of said pulleys and terminates at first end thereof to said first counterweight;

a lateral cable having two ends, said second end thereof attached to said second hoist means associated with said shuttle wherein said lateral cable passes over second of said pulleys and terminates at second end thereof to said second counterweight; and, wherein said power means powers said first and second hoist means.

3. The personal transfer system of claim 1 further having:

a hoist cable running between the facility and said shuttle and a lateral cable running between the facility and said shuttle, wherein said means for operating said shuttle in said float mode is active further comprising:

reduced torque control means controlling said first and second hoist means; and, wherein said power means powers said reduced torque control means.

4. The personal transfer system of claim 1 further having:

a hoist cable running between the facility and said shuttle and a lateral cable running between the facility and said shuttle, wherein said means for operating said shuttle in said float mode is active further comprising:

third hoist means associated with said shuttle;

power control means controlling said first, second, and third hoist means; and, wherein said power means powers said power control means.

5. The personnel transfer system of claim 2 wherein said first and second hoist means are similar each further comprising:

a winch attached to its respective lateral or hoist cable; and, a motor attached to each of said winches.

6. The personnel transfer system of claim 5 wherein said motor is fluid powered.

7. The personnel transfer system of claim 5 wherein said motor is electric powered.

8. The personnel transfer system of claim 3 wherein said first and second hoist means are similar each further comprising:

a winch attached to its respective lateral or hoist cable; and, a motor attached to each of said winches.

9. The personnel transfer system of claim 8 wherein said motor is fluid powered.

10. The personnel transfer system of claim 8 wherein said motor is electric powered.

11. The personnel transfer system of claim 8 wherein said reduced torque control means further comprises means for applying reduced power while in float mode to each of said motors associated with each of said winches such that each of said motors operate in reduced torque and act to drive its associated winch in such a manner as to draw its respective cable onto each of said winches while allowing the fluctuating motion of the floating vessel to pull said respective cable from each of said winches without moving said shuttle while said shuttle is resting on the floating vessel; whereas, when not in float mode full power may be applied to each of said motors such that said first hoist means will operate in said hoist mode and such that said second hoist means will operate in said lateral mode.

12. The personnel transfer system of claim 4 wherein said first and second hoist means are similar each further comprising:

a winch attached to its respective lateral or vertical cable; and, a main motor attached to each of said winches;

wherein said third hoist means comprises a low torque motor attached each of said winches.

13. The personnel transfer system of claim 12 wherein each said motors are fluid powered.

14. The personnel transfer system of claim 12 wherein each said motors are electric powered.

15. The personnel transfer system of claim 12 wherein said power control means further comprises means for applying power while in float mode to each of said reduced torque motors associated with each of said winches such that each of said reduced torque motors act to drive its associated winch in such a manner as to draw its respective cable onto said winch while allowing the fluctuating motion of the floating vessel to pull said respective cable from said winch without moving said shuttle while at the same time inhibiting application of power to each of said main motors whenever said shuttle is resting on the floating vessel; whereas, when not in float mode power may be applied to each of said main motors and inhibited to each of said reduced torque motors such that said first hoist means will operate in said hoist mode and such that said second hoist means will operate in said lateral mode.

16. A personnel transfer system for transferring men and materials between an offshore facility and a floating vessel that requires no specialized attachment points for receiving the transfer system comprising:

a shuttle;

first hoist means associated with said shuttle for operating said shuttle in a hoist mode which substantially raises or lowers said shuttle vertically with respect to the facility;

second hoist means associated with said shuttle for operating said shuttle in a lateral mode which substantially moves said shuttle horizontally with respect to the facility;

third hoist means associated with said shuttle for operating said shuttle in a float mode, said float mode substantially allowing said shuttle to follow the fluctuating motion of the floating vessel induced by wave motion when said shuttle is resting on the floating vessel;

control means associated with said shuttle and said first and second hoist means for controlling said float mode or said hoist and lateral modes; and, power means supplying energy to said control means.

17. A personnel transfer system for transferring men and materials between an offshore facility and a floating vessel that requires no specialized attachment points for receiving the transfer system comprising:

a shuttle;

a hoist cable having two ends;

a hoist winch attached to one end of said hoist cable, wherein said other end of said hoist cable is attached to the facility;

a hoist motor for powering said hoist winch thereby operating said shuttle in a hoist mode which substantially raises or lowers said shuttle vertically with respect to the facility;

a lateral cable having two ends;

a lateral winch attached to one end of said lateral cable, wherein said other end of said lateral cable is attached to the facility;

a lateral motor for powering said lateral winch thereby operating said shuttle in a lateral mode which substantially moves said shuttle horizontally with respect to the facility;

reduced torque hoist means associated with said shuttle for operating said shuttle in a float mode, said float mode substantially allowing said shuttle to follow the fluctuating motion of the floating vessel induced by wave motion when said shuttle is resting on the floating vessel;

control means associated with said shuttle and said first and second hoist means for choosing said float mode or said hoist and lateral modes; and, power means supplying energy to said first, second, and reduced torque hoist means.

18. The personnel transfer system of claim 17 wherein said reduced torque hoist means and said control means are integrated and comprise means for applying reduced power when in float mode to said hoist motor and to said lateral motor such that each of said winches associated with each of said motors act to hold tension in each of said associated cables while allowing the fluctuating motion of the floating vessel to pull said respective cables from each of said winches without moving said shuttle while said shuttle is resting on the floating vessel; whereas, when not in float mode full power may be applied to each of said motors such that said lateral winch will operate in said lateral mode and such that said hoist winch will operate in said hoist mode.

19. The personnel transfer system of claim 18 wherein each said motors are fluid powered.

20. The personnel transfer system of claim 18 wherein each said motors are electric powered.

21. The personnel transfer system of claim 17 said reduced torque means further comprises:

a reduced torque hoist motor attached to said hoist winch; and, a reduced torque lateral motor attached to said lateral winch.

22. The personnel transfer system of claim 21 wherein said control means comprises means for applying power while in float mode to each of said reduced torque motors associated with each of said winches such that each of said reduced torque motors act to drive its associated winch in such a manner as to draw its respective cable onto said winch while allowing the fluctuating motion of the floating vessel to pull said respective cable from said winch without moving said shuttle while at the same time inhibiting application of power to each of said main motors whenever said shuttle is resting on the floating vessel; whereas, when not in float mode power may be applied to each of said main motors and inhibited to each of said reduced torque motors such that said lateral winch will operate in said lateral mode and such that said hoist winch will operate in said hoist mode.

* * * * *